US005643169A

United States Patent [19]

Leung et al.

[11] Patent Number: 5,643,169

[45] Date of Patent: Jul. 1, 1997

[54] DECANTER CENTRIFUGE WITH ADJUSTABLE GATE CONTROL

[75] Inventors: Woon-Fong Leung, Sherborn; Ascher H. Shapiro, Jamaica Plain; Robert S. Yarnell, Franklin, all of Mass.

[73] Assignee: Baker Hughes Incorporated, Houston, Tex.

[21] Appl. No.: 468,205

[22] Filed: Jun. 6, 1995

[51] Int. Cl.[6] ..... B04B 1/20; B04B 11/00

[52] U.S. Cl. ..... 494/53; 494/56

[58] Field of Search ..... 494/1, 7, 52–54, 494/56, 85, 37; 210/380.1, 380.3

[56] References Cited

U.S. PATENT DOCUMENTS

| | | | |
|---|---|---|---|
| 273,037 | 2/1883 | Decastro et al. . | |
| 3,404,833 | 10/1968 | Pause . | |
| 3,454,216 | 7/1969 | Hemfort . | |
| 3,623,656 | 11/1971 | Lavanchy | 494/53 |
| 3,934,792 | 1/1976 | High et al. | 494/54 |
| 3,955,756 | 5/1976 | Hiller . | |
| 4,339,072 | 7/1982 | Hiller . | |
| 4,378,906 | 4/1983 | Epper et al. . | |
| 4,615,690 | 10/1986 | Ecker . | |
| 4,718,886 | 1/1988 | Mackel . | |
| 4,729,830 | 3/1988 | Suzuki | 210/380.3 |
| 4,731,182 | 3/1988 | High . | |
| 4,764,163 | 8/1988 | Caldwell . | |
| 4,784,634 | 11/1988 | Schiele . | |
| 4,950,219 | 8/1990 | Luchetta . | |
| 5,169,377 | 12/1992 | Schlip et al. . | |
| 5,182,020 | 1/1993 | Grimwood . | |
| 5,217,428 | 6/1993 | Schlip et al. . | |
| 5,252,209 | 10/1993 | Retter . | |
| 5,261,869 | 11/1993 | Caldwell et al. . | |
| 5,328,441 | 7/1994 | Carr . | |

FOREIGN PATENT DOCUMENTS

| | | | |
|---|---|---|---|
| 4119003 | 12/1992 | Germany | 494/53 |
| 4-310255 | 11/1992 | Japan | 494/53 |
| 655433 | 4/1977 | U.S.S.R. . | |
| 745543 | 4/1978 | U.S.S.R. . | |
| 1622015 | 1/1991 | U.S.S.R. | 494/53 |

OTHER PUBLICATIONS

"Flow Control Structure in a Decanter Centrifuge" Research Disclosure, No. 347, Mar. 1993, pp. 191–192.

*Primary Examiner*—Charles E. Cooley

*Attorney, Agent, or Firm*—McAulay Fisher Nissen Goldberg & Kiel, LLP

[57] ABSTRACT

A decanter centrifuge comprises a bowl and a worm or screw type conveyor. The bowl is rotatable about a longitudinal axis and has a cake discharge opening at one end and a liquid phase discharge opening. The conveyor includes a conveyor hub having at least a portion disposed inside the bowl for rotation about the longitudinal axis at an angular speed different from an angular rotational speed of the bowl. The conveyor further includes a helical screw or worm attached to the conveyor hub and disposed inside the bowl for scrolling a cake layer along an inner surface of the bowl towards the cake discharge opening. An adjustable component on the hub forms a gap between the hub and the inner surface of the bowl so that the gap has a size adjustable independently of hub rotation speed. The adjustable gap enables an optimization of the moisture content of cake exiting the bowl at the cake discharge opening for a given solids throughput and cake rheology. The adjustable component on the hub takes the form of an annular weir or a baffle plate.

26 Claims, 6 Drawing Sheets

DECANTER CENTRIFUGE WITH ADJUSTABLE GATE CONTROL

BACKGROUND OF THE INVENTION

This invention relates to a decanter centrifuge. In a specific application, this invention relates to a decanter centrifuge with means for controlling the moisture content of a discharged cake or solids fraction. This invention also relates to an associated method for operating a decanter centrifuge.

A decanter centrifuge generally includes an outer bowl, an inner hub carrying a worm conveyor, a feed arrangement for slurry to be processed, and discharge ports for cake solids and clarified liquid. The bowl includes a cylindrical section and a conical beach section. The bowl and the hub are rotated at high, slightly different angular speeds so that heavier solid particles of a slurry introduced into the bowl are forced by centrifugation into a layer along the inner surface thereof. By differential rotation of the worm conveyor and the bowl, the sediment is pushed or scrolled to a cake discharge opening at the smaller, conical end of the bowl. Additional discharge openings are provided in the bowl, usually at an end opposite of the conical section for discharging a liquid phase separated from the solid particles in the centrifuge apparatus.

One of the goals in centrifuge operation is to produce cakes with a low moisture content. Among factors contributing to a low cake moisture content are a long residence time and a high compacting pressure. The compacting pressure is related to the G level (centrifugal acceleration) and the cake height. The compacting pressure generated by a column of sludge varies with the radial distance from the bowl wall. It is highest at the bowl wall and decreases radially inward. FIG. 10A shows a typical result of raw mixed sewage sludge which is compacted in a laboratory spin tube (1.3 inches in diameter and at a radius of 8 inches) under a force determined by the G level and the cake height. In one test, the cake height is about 2 inches and is compacted under 2000 g. In another test, the raw mixed sewage sludge is subjected to 900 g with a thicker cake pile of 2.6 inches. In both cases, the cake solids profile is stratified with the driest cake at the largest radius, adjacent to the outer wall of the spin tube.

In addition, it is known to form a dip weir along the outer surface of the conveyor hub, at or about the location of the junction between the cylindrical and conical sections of the bowl, to serve in selecting the driest portion of the cake at the discharge end of the bowl. The dip weir blocks the transport of the sludge cake in such a manner that the most compacted part of the cake passes under the dip weir and reaches the cake discharge opening. The dip weir also acts to provide the appropriate resistance to cake flow so as to maintain a large cake thickness upstream of the weir, creating high compacting pressure and long residence time. In conventional practice, the dip weir is fixed to the hub so that the radial gap between the outer edge of the dip weir and the inner surface of the bowl is constant or fixed. The designer must position and dimension the weir to minimize cake moisture content while not increasing cake transport resistance through the gap so as to unduly limit the solids capacity of the machine. The optimal gap height depends on the nature of the cake, the G level, and the cake flow rate or solids throughput. The designer is forced to guess at the correct gap height, guided somewhat by past experience.

Another application for a decanter centrifuge is in three-phase separation (as in oil, water and solids) wherein typically two lighter liquid phases (e.g., oil and water) are discharged at the large end of the decanter centrifuge and the heaviest solid phase, settled adjacent to the bowl wall, is discharged at the smaller conical end of the centrifuge. In a three-phase separation process, centrifugation stratifies the phases because of their density differences. A problem with three-phase separation is that the lightest phase (oil) is typically entrained by the solid phase as it emerges out of the oil-water pool in the conical section. The quantity of oil carried along by the cake solids depends on several factors including the surface velocity of the cake and the product of the centrifugal acceleration and the sine of the climb angle. The surface velocity of the cake is related to the differential speed of the conveyor and the bowl, the cake height or solids throughput, and the cake theological properties.

SUMMARY OF THE INVENTION

A decanter centrifuge comprises, in accordance with the present invention, a bowl, a worm or screw type conveyor, and a feed arrangement for delivering a slurry to a pool in the bowl. The bowl is rotatable about a longitudinal axis and has a cake discharge opening at one end and a liquid phase discharge opening. The conveyor has at least a portion disposed inside the bowl for rotation about the longitudinal axis at an angular speed different from an angular rotational speed of the bowl. The conveyor includes a helical screw or worm disposed inside the bowl for scrolling a cake layer along an inner surface of the bowl towards the cake discharge opening. A gating element attached to the conveyor forms a gap between the gating element (more particularly, the outer edge thereof) and the inner surface of the bowl so that the gap size is adjustable independently of conveyor rotation speed and, accordingly, of the G level. The adjustable gap enables an optimization of the moisture content of cake exiting the bowl at the cake discharge opening. Where there are a plurality of liquid phases (e.g., oil and water), the gating element with a properly set opening may be used to block the lightest liquid phase from entrainment by the cake layer at the conical end of the decanter centrifuge as the cake comes out of the liquid pool, thereby facilitating or enabling more effective three-phase separation. Another use of the gating element is to block fine particles from carrying over with coarse particles in the cake, thereby facilitating classification of clays and other fine particles.

Preferably, the gating element is movably mounted to the conveyor and locking hardware is provided for maintaining the gating element at a predeterminable location relative to the conveyor. The gating element includes an edge defining the gap relative to the inner surface of the bowl, the edge being spaced from that inner surface by an adjustable distance.

In one specific configuration of the decanter centrifuge, the gating element may include a baffle plate disposed between adjacent wraps of the screw conveyor. In this case, the locking hardware may alternatively include a hydraulic circuit, a camming mechanism, a rocker-arm lever mechanism, or a bolting arrangement.

It is to be additionally noted that where the conveyor has a plurality of screw flights or helixes, there must be a plurality of gating elements or baffle plates. Each baffle plate is disposed between adjacent wraps of the helical screws so that the cake distributed among the formed helical channels encounters similar restrictions in each channel.

Where there are plural baffle plates (plural gating elements), the baffle plates are disposed symmetrically about the rotation axis of the conveyor to facilitate or enhance balancing of the conveyor.

The hardware for adjusting and locking the gating element in a predeterminable position may serve to enable manual or automatic adjustment of the gap between the gating element and the inner surface of the bowl. In the case of manual adjustment, the hardware is mounted to the conveyor, for example, to the hub of the conveyor, and is operatively connected to the gating element. A simple arrangement is to bolt a baffle onto a supporting bracket which bridges across adjacent screw wraps near the outer diameter of the conveyor hub. Rebolting the baffle(s) changes the baffle size and concomitantly the gap size. The baffle can be changed by reaching in from the open space of the cake discharge end of the machine, provided the bracket assembly is accessible. Alternatively, when the mechanism is located in a less accessible position, the adjustment can be made through an access window in the bowl wall or by adjusting jack screws that pass through the bowl wall. In such cases, the adjustment of the gating element or baffle requires centrifuge stoppage, prior to reaching in through the access hole in the bowl, repositioning the jack screws or removal of the end closure head of the bowl. Alternatively, a coupling or linkage mechanism may be provided for enabling manual adjustment even during operation of the centrifuge. For instance, where the adjusting and locking hardware is hydraulic, slippage couplings are provided for connecting stationary and rotating portions of the hydraulic circuit. The reservoir of pressurization fluid may be fixed or rotating with the conveyor.

Also possible, but much more expensive, is automatically varying the position of the gating element, and accordingly the gap between the same and the inner bowl surface. This automatic adjustment may be implemented, for example, in accordance with feedback from a sensor monitoring cake moisture content. A microprocessor programmer may be provided for controlling gating element position pursuant to such input instructions and variables as the cake moisture, the G level and the cake flow rate so that the decanter is operating optimally at all times given the variation of the feed conditions.

In another specific configuration of the decanter centrifuge, the bowl has a cylindrical portion and a conical portion, the conical portion defining a beach area on the inner surface of the bowl, while the gating element includes an annular dip weir disposable at different longitudinal positions along the conveyor. In a second configuration, the beach area may include a first section proximate to the cake discharge opening of the centrifuge and a second section adjacent to the cylindrical portion of the bowl. The first section has a slope which is less than the slope of the second section, that is, the angle of inclination of the first section relative to the longitudinal rotation axis of the decanter centrifuge is less than the angle of inclination of the second section of the beach area of the bowl. In that case, the dip weir is positioned along the first section of the beach area.

A decanter centrifuge comprises, in accordance with another conceptualization of the present invention, a bowl rotatable about a longitudinal axis, a conveyor having at least a portion disposed inside the bowl for rotation about the longitudinal axis at an angular speed different from an angular rotational speed of the bowl, and a feed delivery system for introducing a feed slurry into the bowl. The bowl has a cake discharge opening at one end and a liquid phase discharge opening, and the conveyor includes a helical screw inside the bowl for scrolling a cake layer along an inner surface of the bowl towards the cake discharge opening. The decanter centrifuge further incorporates a gating element defining an adjustably variable gap between the gating element and the inner surface of the bowl. The gating element may serve to control solids concentration of the cake at the discharge opening. Alternatively, where there are a plurality of liquid phases, the gating element may be used to block the lightest liquid phase from entrainment to the cake layer. In another use, the gating element serves to block the slowly settling fine particles, which stay close to the surface of the liquid pool, from exiting the centrifuge with the fast settling coarse particles via the cake discharge opening.

A locking mechanism may be mounted to the conveyor and operatively connected to the gating element for enabling a locking of the gating element to the conveyor at different positions so as to vary the predeterminable distance between the gating element and the inner bowl surface. Thus, control solids concentration of the cake at the discharge opening may be controlled independently of rotation rate of the conveyor.

An adjustment mechanism may be mounted to the conveyor and operatively connected to the gating element for enabling a manual adjustment in the position of the gating element relative to the conveyor. As discussed hereinabove, where the screw has a plurality of wraps, the gating element may include a baffle plate disposed between adjacent wraps of the screw. Alternatively, as also discussed above, the gating element may take the form of a dip weir disposable at different longitudinal positions along the conveyor in juxtaposition to a beach section of the bowl.

A method for operating a decanter type centrifuge comprises, in accordance with the present invention, (a) feeding a slurry into a bowl, (b) rotating the bowl about a longitudinal axis at a first rate of rotation, (c) rotating a screw conveyor about the longitudinal axis at a second rate of rotation different from the first rate of rotation, (d) scrolling a cake layer via the screw conveyor along an inner surface of the bowl towards a first discharge opening at one end of the bowl, and (e) discharging cake through the first discharge opening and a liquid phase through a second discharge opening in the bowl. The conveyor is provided with a movable gating element for setting an adjustable gap between the conveyor and the inner surface of the bowl, and the centrifuge operating method further comprises (f) adjusting a location of the gating element relative to the conveyor to change the gap between the gating element and the inner surface of the bowl. In a further implementation of the method, (g) rotation of the bowl and the conveyor continues at respective, different rates of rotation and cake continues to be discharged through the first discharge opening and the liquid phase through the second discharge opening upon completion of the adjusting.

According to another feature of the present invention, the method further comprises arresting rotation of the bowl and the conveyor prior to the adjustment in the location of the gating element relative to the inner surface of the bowl.

As discussed above, the adjustment of the gating element and particularly the gap between the gating element and the inner surface of the decanter bowl may be implemented by manually adjusting the location of the gating element. Manual adjustment may be effectuated through an access opening in the bowl, or after removal of an end closure head of the bowl.

Where the gating element includes a baffle plate disposed between adjacent wraps of the screw conveyor, the adjustment of the gating element and its gap includes shifting the baffle plate in at least a partially radial direction.

Where the gating element takes the form of a shiftable dip weir, adjusting the gating element and its gap includes shifting the dip weir longitudinally along the conveyor. In one configuration of the dip weir, shifting the dip weir in one direction axially decreases the gap between the dip weir and the inner surface of the bowl beach and concomitantly decreases the thickness of cake layer fed to the cake discharge opening and the associated moisture content of the cake discharge. Shifting the dip weir in the other axial direction has the opposite effect: the gap between the dip weir and the inner surface of the bowl beach and concomitantly the thickness of cake layer fed to the cake discharge opening and the moisture content of the cake discharge are all increased.

In the foregoing description, the dip weir has an outer diameter which decreases in the direction of cake advancement up the beach area of the decanter bowl. In another configuration of the dip weir, it has an external diameter which increases in the direction of cake advancement up the beach area of the decanter bowl. In this modified configuration of the dip weir, shifting the dip weir in the one direction axially increases the gap between the dip weir and the inner surface of the bowl beach and concomitantly increases the thickness of cake layer fed to the cake discharge opening and the associated moisture content of the cake discharge. Shifting the modified dip weir in the other axial direction has the opposite effect: the gap between the dip weir and the inner surface of the bowl beach and concomitantly the thickness of cake layer fed to the cake discharge opening and the moisture content of the cake discharge are all decreased.

The experimental results shown in FIGS. 10A and 10B suggest that a decanter centrifuge should be operated at deep pool and high G, with a metering device provided to produce the driest cake next to the bowl wall. The gating element acts as a metering device, to control the moisture of cake exiting the centrifuge.

A decanter centrifuge in accordance with the present invention thus provides for a greatly enhanced capability for controlling sludge cake moisture content. The gating element gap can be adjusted to provide a desired cake moisture content regardless of variations, for example, in the nature of the cake, the G level and the cake flow rate. In this application (cake moisture control), when the gating or metering element includes one or more baffles between adjacent wraps of the conveyor screw and when the continuous cake flow fills the gap between the outer edge of the gating element and the inner surface of the bowl wall, the baffles act as a seal to expressed liquid dewatered from the cake downstream of the gating element. Such expressed liquid would then be carried with the cake to discharge. Therefore, it is beneficial to locate the gating element in the vicinity of the cake discharge end in order to maximize dewatering of the cake in the decanter centrifuge.

In a decanter centrifuge for implementing a three-phase separation, a gating element (e.g., dip weir) placed upstream of the solids emergence zone, in accordance with the present invention, serves to reduce entrainment of the lightest phase by the solid phase as the latter emerges from the oil-water pool in the conical section of the centrifuge. It is to be noted that the outer diameter of the gating element must penetrate beyond the two-liquid (oil-water) interface to be effective.

A decanter centrifuge with an adjustable gating element in accordance with the present invention is advantageous in the classification of fine solids wherein the "product" fine solids which stay near the pool surface due to lower settling velocity are allowed to pass with the liquid to the large end of the decanter centrifuge, while the "reject" coarser particles which settle quickly to the bowl wall are conveyed toward the conical discharge end. A dip weir in accordance with the invention blocks the fine solids from being entrained by the coarser cake solids as the solids emerge out of the separation pool and at the same time provides a requisite hydrostatic head to convey the coarse solids which might exhibit plastic fluid behavior, such as with kaolin cake.

In general, a gating or metering element with an adjustably variable position in accordance with the present invention provides control of cake quality. Specifically, the gating element enables control of cake moisture content, the quantity of light liquid phase carryover in a three-phase system, and the degree or proportion of fine solids in the cake output.

BRIEF DESCRIPTION OF THE DRAWING

Like reference numerals in the drawings designate the same structural elements.

DETAILED DESCRIPTION

Figure 1:
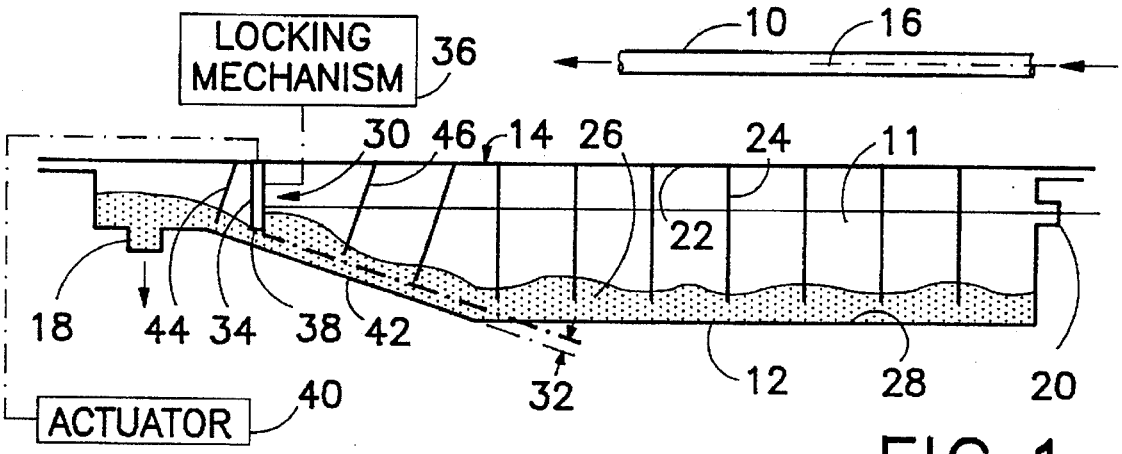
FIG. 1 is a diagram of a decanter centrifuge in accordance with the present invention.

FIG. 1 diagrammatically illustrates the lower half of a decanter type centrifuge comprising a solid or perforated bowl 12, a worm or screw type conveyor 14, and a slurry feed arrangement that includes a feed pipe 10, a feed compartment (not shown) and one or more openings (not shown) in the conveyor hub 22 to allow slurry to pass from the feed compartment to a liquid pool 11 in the bowl. Bowl 12 is rotatable about a longitudinal axis 16 and has a cake discharge opening 18 at one end and a liquid phase discharge opening 20 at an opposite end. Conveyor hub 22 has at least a portion disposed inside bowl 12 for rotation about longitudinal axis 16 at an angular speed different from an angular rotational speed of bowl 12. Conveyor 14 further includes a helical screw or worm 24 attached to conveyor hub 22 and disposed inside bowl 12 for scrolling a cake layer 26 along an inner surface 28 of bowl 12 towards cake discharge opening 18. An adjustable component 30 on conveyor hub 22 forms a gap 32 between the hub and inner surface 28 of bowl 12 so that the gap has a size adjustable independently of hub rotation speed. Adjustable gap 32 enables an optimization of the moisture content of cake exiting bowl 12 at cake discharge opening 18 or other performance parameters.

Preferably, adjustable component 30 includes a gating element 34 movably mounted to hub 22 and locking hardware 36 for maintaining the gating element at a predeterminable location relative to the hub. Gap 32 is defined by an edge 38 of gating element 34 and the inner surface 28 of bowl 12. The magnitude of gap 32 is adjustable by shifting gating element 34 towards or away from inner surface 28. Preferably, gating element 34 is operatively connected to an actuator 40 which is disposed inside hub 22 and bowl 12, but may be disposed outside of those components. Actuator 40 is located so that the position of gating element 34 may be adjusted without significant disassembly of the decanter centrifuge.

Figure 2:
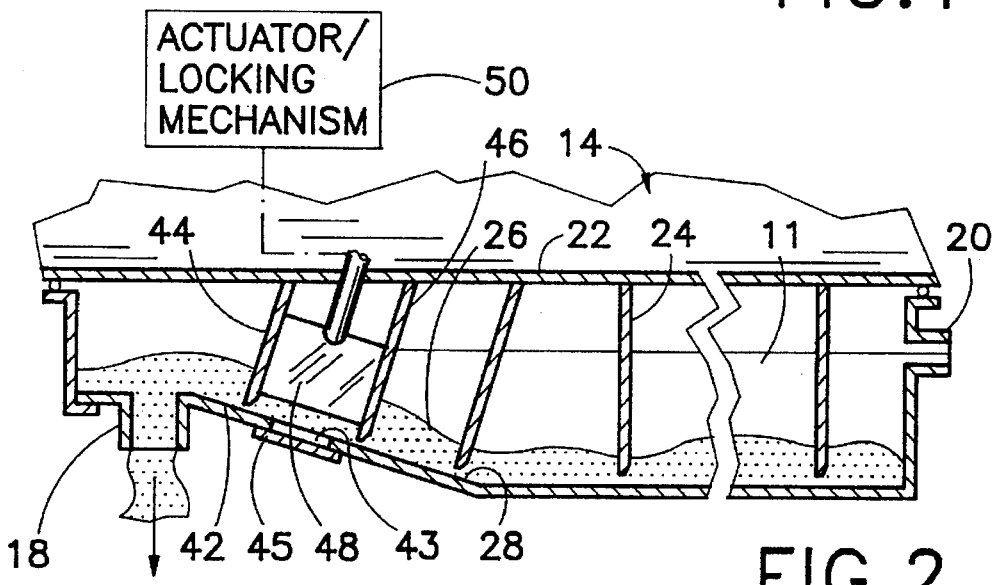
FIG. 2 is a schematic partial longitudinal cross-sectional view of a specific embodiment of a decanter centrifuge according to FIG. 1.

Generally, gating element 34 is juxtaposed to a beach section 42 of bowl 12 and cooperates therewith in defining gap 32. Gating element 34 may be disposed between a pair of adjacent wraps 44 and 46 of conveyor screw 24, as shown in FIGS. 1 and 2. Alternatively, gating element 34 may be disposed downstream of the last wrap 44 of conveyor screw 24, as discussed hereinafter with reference to FIGS. 7 and 8.

As illustrated in FIG. 2, gating element 34 may take the form of a baffle plate 48 disposed between adjacent wraps 44 and 46 of screw 24. Baffle plate 48 is disposed approximately perpendicularly to wraps 44 and 46 and may be guided in grooves 92 (see FIG. 6) provided therein. The functions of actuator 40 and locking mechanism 36 may be combined in a single hardware assembly or mechanism 50.

As discussed above, mechanism 50 may serve to enable manual or, alternatively, automatic adjustment of the gap 32 between inner surface 28 of bowl 12, on the one hand, and conveyor hub 22 or, more particularly, baffle plate 48, on the other hand. In the case of manual adjustment, mechanism 50 is at least partially mounted to conveyor hub 22 and is operatively connected to baffle plate 48 for enabling a manual adjustment. Manual adjustment may require centrifuge stoppage, followed by either partial disassembly of the decanter centrifuge or by accessing the locking mechanism 36 through an access opening 43 provided in beach section 42 of bowl 12. Alternatively, a coupling or linkage mechanism (not shown) may be provided for enabling manual adjustment even during operation of the centrifuge. For instance, where adjusting and locking hardware 50 is hydraulic (FIG. 5), slippage couplings (not shown) are provided for connecting stationary and rotating portions of the hydraulic circuit. The reservoir 70 of pressurization fluid (see FIG. 5) may be fixed or rotating with conveyor hub 22.

The position of baffle plate 48, and accordingly the gap 32 between the baffle plate and inner bowl surface 28, may be automatically varied in accordance with feedback from a sensor (not shown) monitoring cake moisture content. A microprocessor programmer (not shown) may be provided for controlling the position of baffle plate 48 pursuant to such input instructions and such variables as the nature of the cake, the G level and the cake flow rate.

Figure 3:
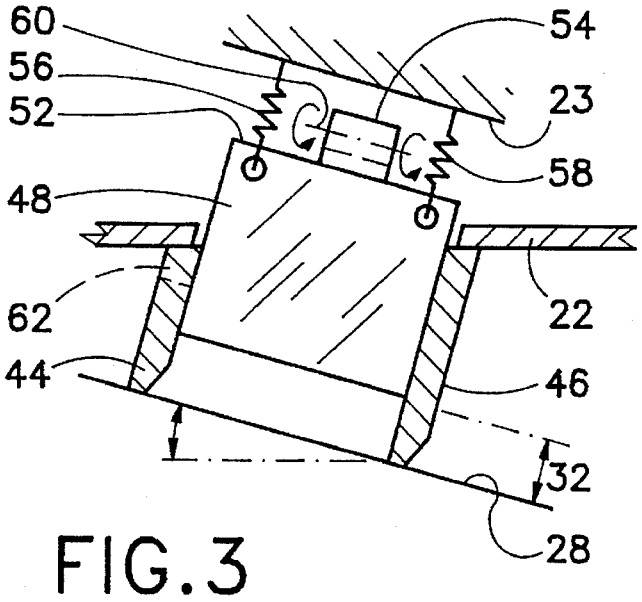
FIG. 3 is a schematic front elevational view of a gating element and a particular embodiment of an associated actuator and locking mechanism shown in FIG. 2.
Figure 4:
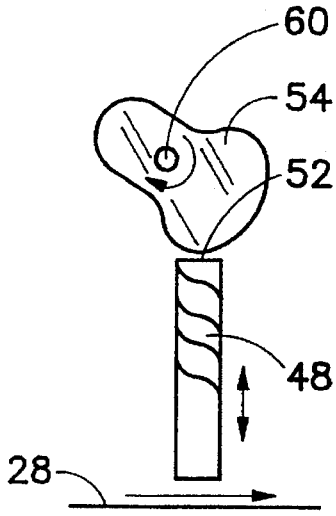
FIG. 4 is a schematic side view of the gating element and associated cam actuator and locking mechanism of FIG. 3.

FIGS. 3 and 4 illustrate a specific embodiment of actuator and locking mechanism 50. A radially inner edge 52 of baffle plate 48 is held in engagement with a camming element 54 by means of one or more biasing springs 56 and 58 coupled at their inner ends to a plate 23 fixed to conveyor hub 22. As camming element 54 is turned or pivoted about an eccentric axis of rotation 60 via a non-illustrated linkage mechanism, baffle plate 48 reciprocates in a radial direction, thereby modifying the size of gap 32. Camming element 54 and springs 56 and 58 are housed inside conveyor hub 22 to prevent solids from jamming the mechanism. Conveyor wrap 44 can be provided with a window 62 traversed by the linkage mechanism (not illustrated).

Baffle plate 48 may be located in a plane which is approximately parallel to the common longitudinal axis 16 (FIG. 1) of rotation of bowl 12 and conveyor hub 22. This orientation is not critical, however, and the baffle plate 48 may be disposed in a plane oriented at an angle relative to rotation axis 16. Moreover, a second baffle plate (not shown) may be provided on conveyor hub 22 in diametric opposition to baffle plate 48.

Gating element 34 and, more particularly, baffle plate 48 serves to control the solids concentration admitted for discharge at opening 18. Baffle plate(s) 48 divides the annular space between bowl 12 and conveyor hub 22 into two regions with a distinct difference in liquid pool and solids level across the baffle plate. Upstream of baffle plate 48, in a direction opposite to the flow of cake layer 26, the pool and solids level is deeper as set by the centrate weir. The deeper pool enhances clarification and a build-up of a thicker cake layer 26 for compaction and dewatering and also provides buoyancy to reduce conveyance torque. Downstream of baffle plate 48, the solids level is controlled by the spillover point of beach section 42. There cake layer 26 is strongly affected by the centrifugal field such that the surface of the cake layer is roughly parallel to rotation axis 16 and is approximately at the radius of the spillover. The baffle plate 48 skims off the driest solids adjacent to bowl inner surface 28.

Cake solids in gap 32, which is generally between 0.25 and 1.5 inches wide, depending on the process, the size of the machine and the throughput, form a "plug" to seal the deep pool 11 on the upstream side of the machine (right side in FIGS. 1 and 2) from the shallower pool with concentrated solids on the downstream side of the machine (beach discharge end at the left side in FIGS. 1 and 2). The position of baffle plate 48 relative to wraps 44 and 46 should be adjusted to change the size of gap 32 as needed by the process, specifically to skim off the driest solids near the bowl wall or to reduce instability caused by washout of the plug. It is desirable to have the size of gap 32 adjustable while the machine is running. However, it is satisfactory when the position of baffle plate 48 can be adjusted without disassembling the machine, for instance through access opening 43 under cover plate 45, while the centrifuge is stationary.

Figure 5:
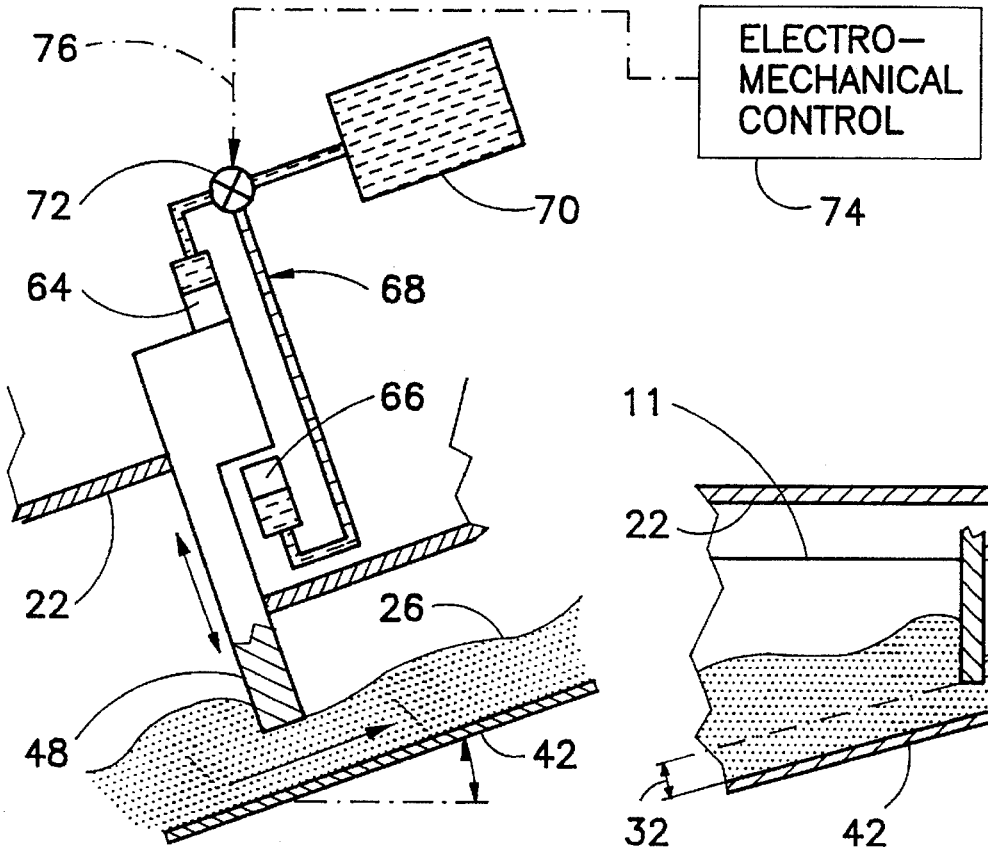
FIG. 5 is a schematic side elevational view of another gating element and associated fluid actuator and locking mechanism for implementing the decanter centrifuge of FIG. 2.

As illustrated in FIG. 5, another specific embodiment of actuator and locking mechanism 50 includes a pair of pistons 64 and 66 connected in a hydraulic circuit 68 to a pressurized oil reservoir 70 via a closed-loop hydraulic switch or valve 72 which is remotely controlled via an electro-mechanical control 74 external to bowl 12.

The linkage mechanism for turning camming element 54 (FIGS. 3 and 4) or a connection 76 from electro-mechanical control 74 (FIG. 5) may rotate with conveyor hub 22. To effectuate an adjustment in the position of baffle plate 48, slippage couplings (not shown) are provided for connecting stationary and rotating portions of actuator and locking mechanism 50. In this case, baffle plate 48 can be adjusted while the machine is running.

Figure 6:
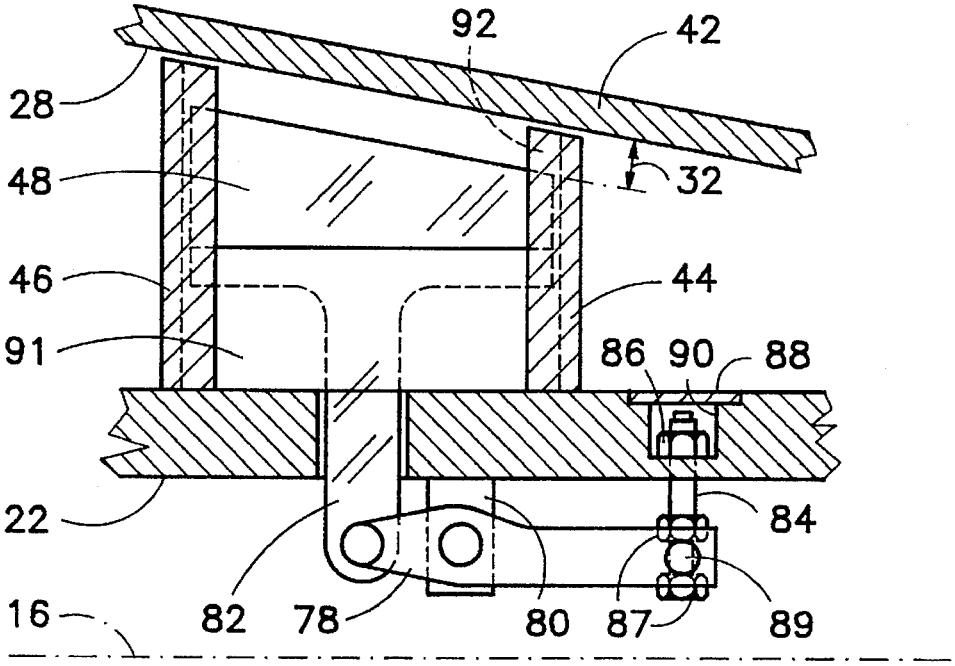
FIG. 6 is a schematic front elevational view of yet another gating element and associated actuator and locking mechanism for implementing the decanter centrifuge of FIG. 2.

FIG. 6 depicts yet another embodiment of actuator and locking mechanism 50 which includes a rocker-arm lever 78 pivotably connected to hub 22 via a fulcrum post 80 and pivotably linked at one end to a stub 82 of baffle plate 48. At an opposite end, the orientation of rocker-arm lever 78 is controlled by a stud 84 threaded to the conveyor hub 22 by a locknut 86 during centrifuge operation. A cover 88 is provided on hub 22 over an access aperture 90. Retainers such as brazed jam nuts 87 are provided on opposite sides of lever arm 78 for suitably securing stud 84 thereto. Lever arm 78 is further furnished with a swivel 89 having a throughhole for providing a rotating fit for stud 84.

Baffle plate 48 is preferably made of titanium with a ceramic wear surface and is slidably arranged between two fixed plates 91 and in grooves 92 provided in conveyor worm wraps 44 and 46. Baffle plate 48 may be maintained in position partially by virtue of centrifugal force.

Where only one baffle plate 48 is provided, conveyor hub 22 is balanced with the baffle plate installed and positioned centrally with respect to its range. Any further minor changes may be counterbalanced with a large-diameter set screw and locking nut (not shown) 180° opposite in the end of the conveyor hub 22.

Figure 7:
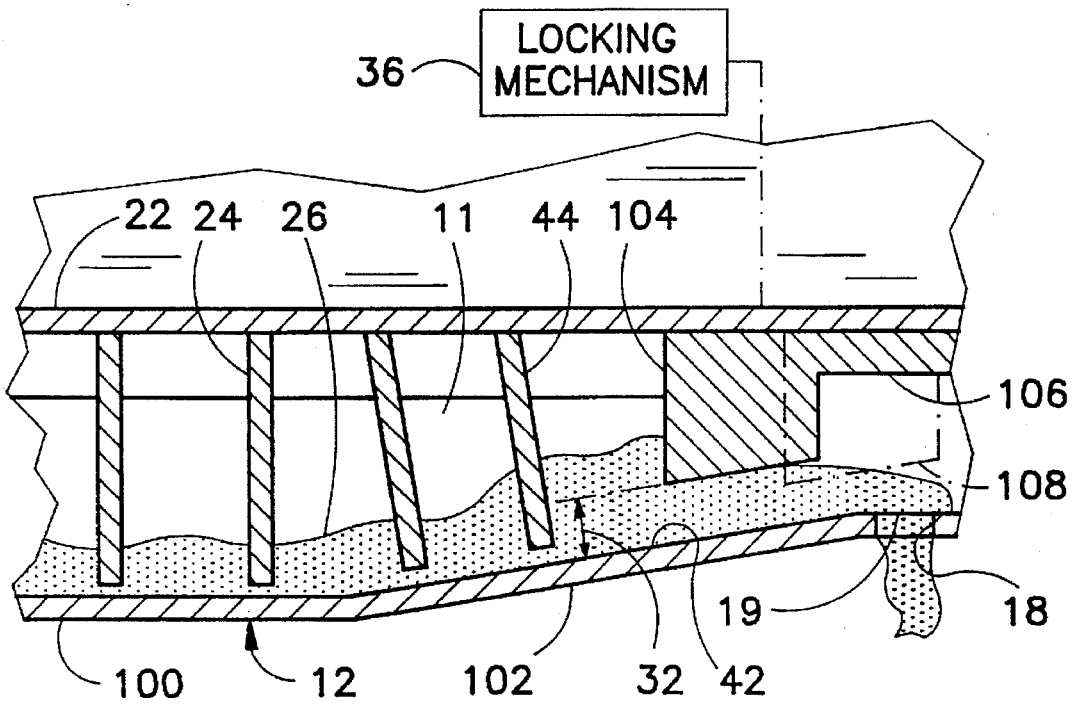
FIG. 7 is a schematic partial longitudinal cross-sectional view of another embodiment of a decanter centrifuge according to FIG. 1.

In another specific configuration of the decanter centrifuge, illustrated in FIG. 7, bowl 12 has a cylindrical portion 100 and a conical portion 102 defining beach section 42 along its inner surface. Gating element 34 takes the form of an annular dip weir 104 disposable at different longitudinal positions along conveyor hub 22. Dip weir 104 is provided with an annular rod 106 extending outside of centrifuge bowl 12 for enabling a manual repositioning of weir 104, as indicated by phantom lines 108, to change the size of gap 32 between dip weir 104 and beach section or surface 42. Rod 106 enables weir position adjustment from outside the machine, without disassembly. Moreover, as discussed hereinabove, this adjustment may be implemented while the machine is running, in the event that slippage couplings (not shown) are provided for connecting stationary and rotating portions of rod 106. Alternatively, the position of dip weir 104 may be adjusted by shutting down the machine, reaching in through an access opening 43 under cover plate 45 in bowl 12, manually unlocking the dip weir, and sliding it axially to another position. Dip weir 104 is then fixed in the new position relative to hub 22 by locking hardware or mechanism 36 (FIG. 1).

It is to be noted that for compactible cake solids, decanter centrifuges generally run with "superpool": the pool level (set by effluent weirs) is radially inward of the radial position of cake discharge opening 19. All the cake 26 is therefore acted upon by buoyancy and, in addition, "hydraulic assist" due to the superpool head forces the cake toward cake discharge opening(s) 18. With the design of FIG. 7, the amount of superpool must be set large enough so that cake layer 26 is transported to cake discharge opening(s) 19 even though part of beach section 42 is without a conveyor.

Figure 8:
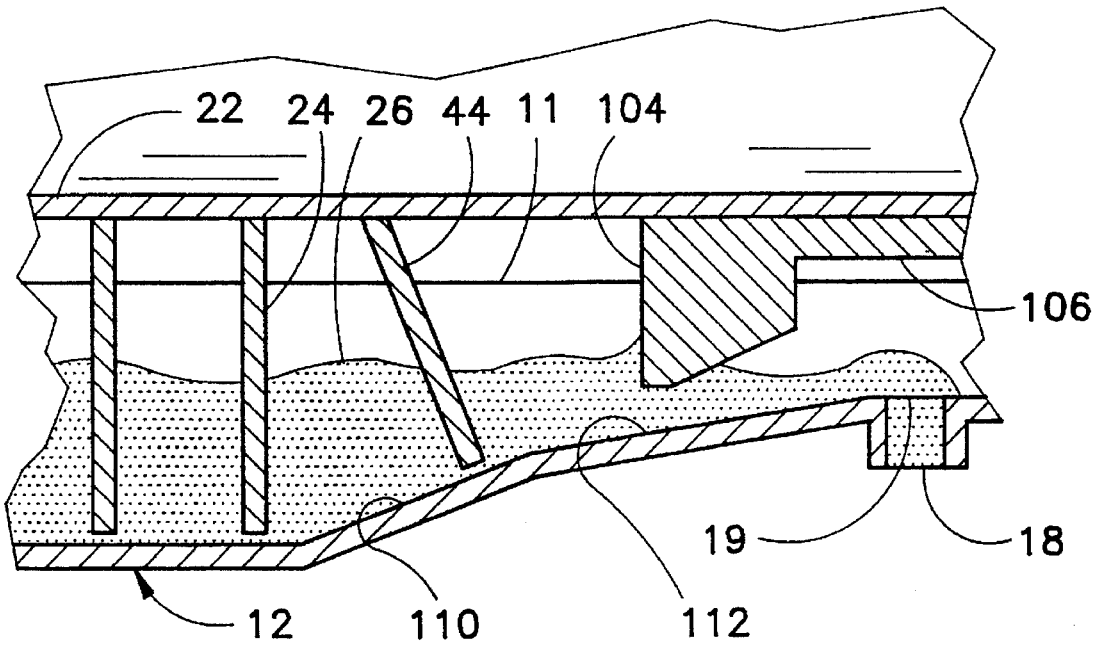
FIG. 8 is a view similar to FIG. 7, showing a modification of the decanter centrifuge of that drawing figure.

As illustrated in FIG. 8, the embodiment of FIG. 7 may be modified by dividing beach section 42 into two portions or areas 110 and 112 with different slopes. Dip weir 104 is positionable along beach portion 112 which has a smaller slope than beach area 110, thereby providing a greater degree of adjustability in the size of gap 32. The increased amount of superpool head required by the conveyor-free portion 112 of beach section 42 may be used to further advantage in the configuration of FIG. 8. Here, beach portion 110 is provided with conveyor wraps 114 and is steeper than beach portion 112. This allows the conveyor-free beach portion 112 to be longer, without changing the overall length.

In the embodiments of FIGS. 7 and 8, dip weir 104 has an outer diameter which decreases in a direction of cake advancement, towards discharge opening 18. In a modified configuration, dip weir 104 may have an external diameter which increases from left to right in FIGS. 7 and 8.

Figure 9:
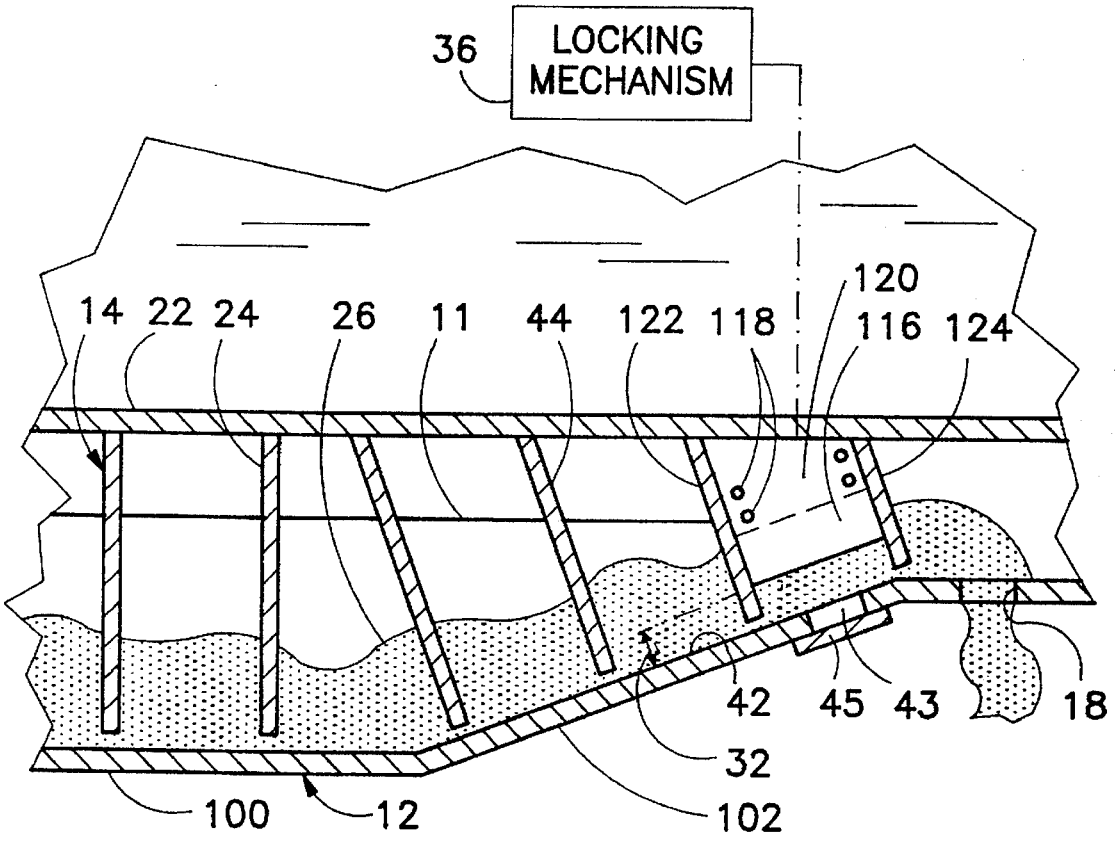
FIG. 9 is a schematic partial longitudinal cross-sectional view of a baffle bolted onto a mounting bracket which bridges across adjacent screw wraps.

As depicted in FIG. 9, a modified decanter centrifuge includes a cake gating or metering mechanism in the form of a baffle plate 116 attached via bolts 118 to a bracket 120 which in turn extends between and is connected to adjacent wraps 122 and 124 of conveyor 14. To adjust gap 32 between baffle plate 116 and beach section 42 of bowl 12, cover plate 45 is removed to allow access to the baffle plate through opening 43. Bolts 118 are loosened and baffle plate 116 shifted relative to bracket 120.

Figure 10A:
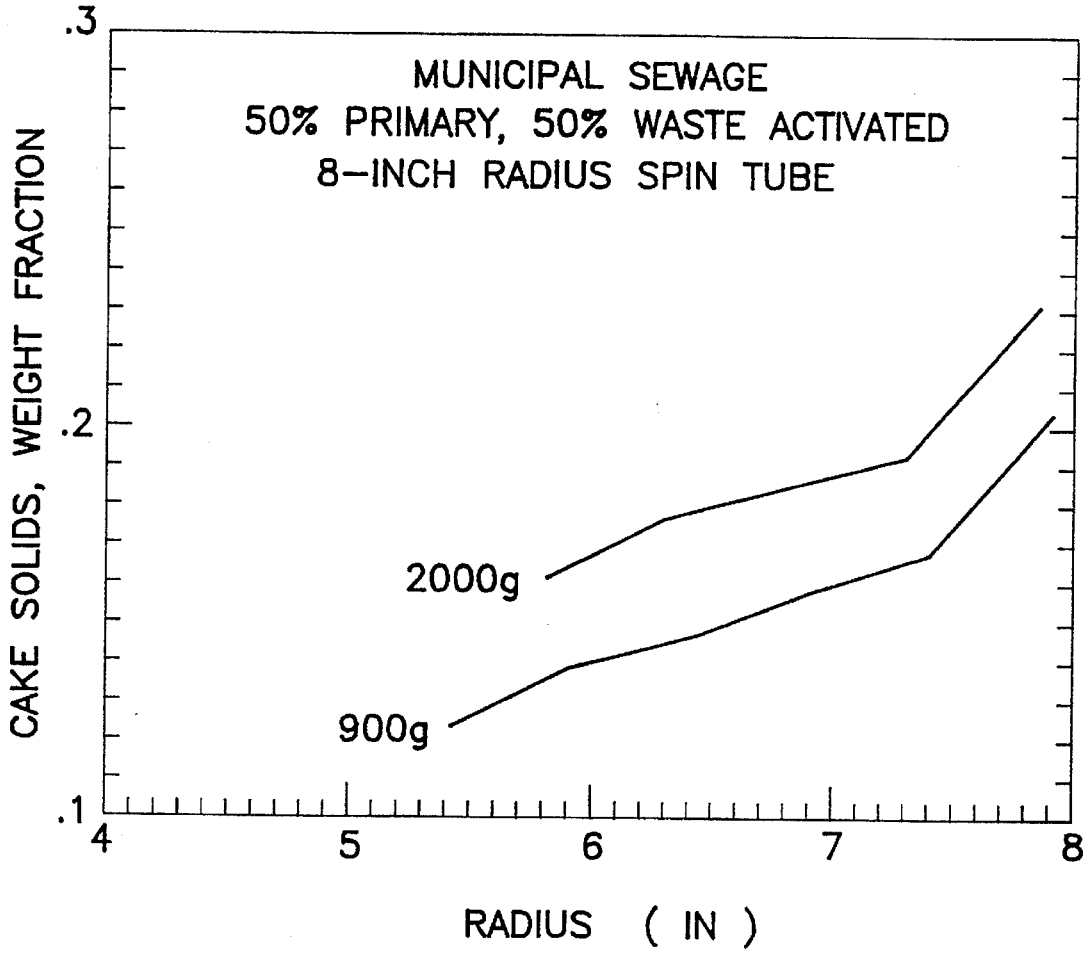
FIG. 10A is a graph showing cake solids weight fraction as a function of distance from a rotation axis in a centrifugation experiment.
Figure 10B:
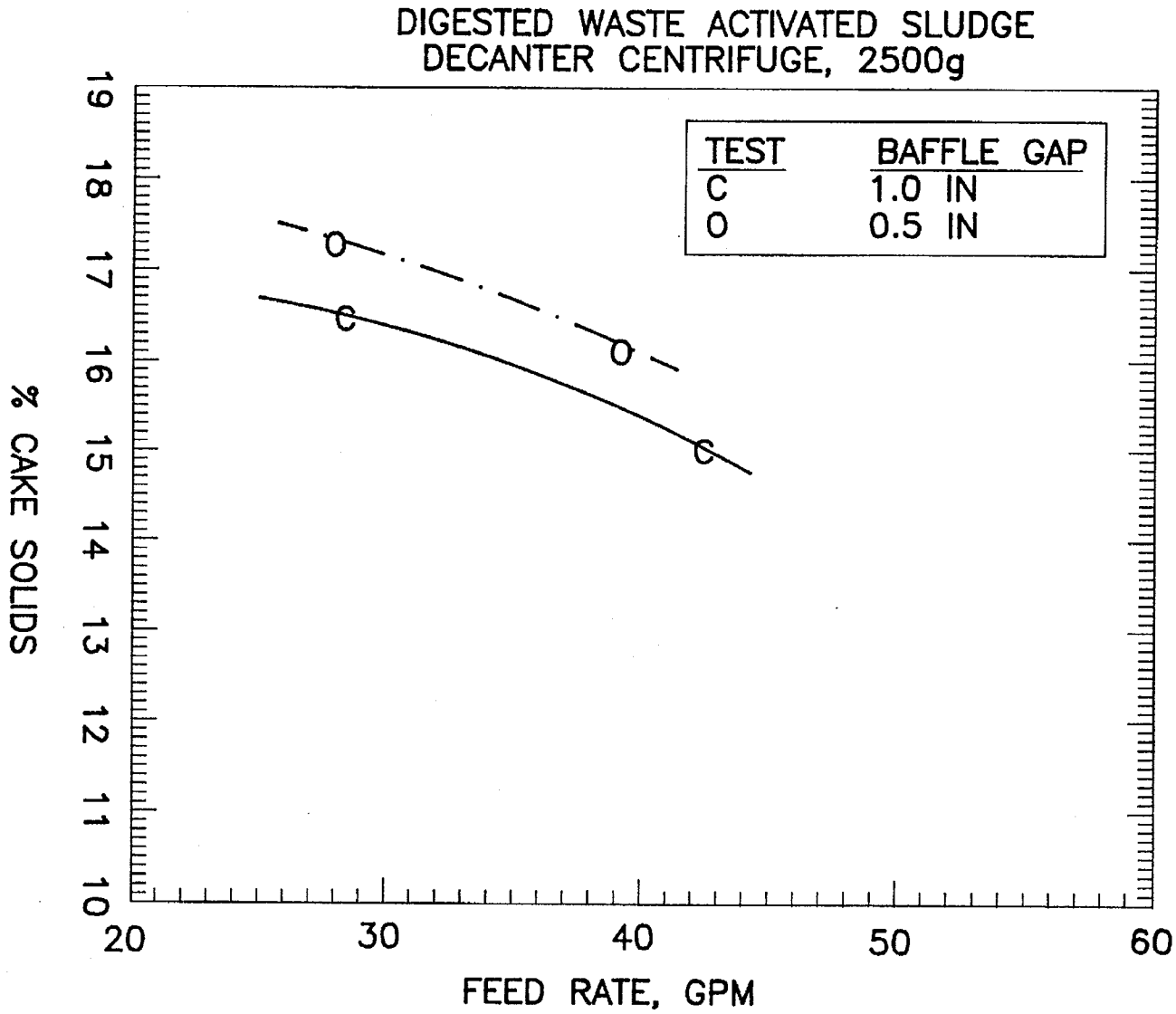
FIG. 10B is another graph showing a cake solids percentage output as a function of slurry feed rate for a decanter centrifuge, respectively set at two different gate openings.

FIG. 10B shows the results of dewatering fluid-like digested waste activated sludge using a continuous feeding decanter centrifuge with an adjustable gating gap, as described hereinabove. The cake solids are plotted against volumetric feed rate in gpm. The test rates are between 27 and 43 gpm. At any given rate, the cake solids produced with a gating or metering gap of 0.5 inch are about 1% drier than the solids produced with a 1-inch gating or metering gap.

Figure 11:
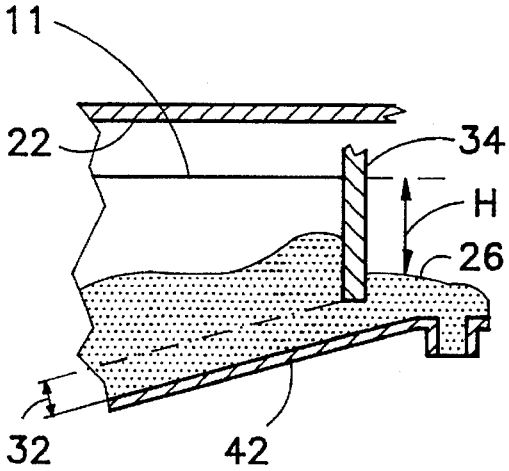
FIG. 11 is a baffle plate or gating element in accordance with the present invention, showing a difference in heights between clarified liquid on one side and cake on an opposite side of the baffle plate.

Another purpose of having an adjustable baffle/gating element is to foster a deep pool operation (which is beneficial as discussed above) such that the pool level is very much above the spill-over point (super-pool) as indicated schematically by the distance H in FIG. 11 between the height of cake 26 at an outlet side of baffle or gating element 34 and the height of pool 11. How much the pool level increments across baffle or gating element 34 depends on the flow resistance, which in turn depends on the solids rate, the size of gap 32 and the rheological properties of the cake. Gap 32 is usually between 0.25 inch and 1.5 inch. For a high solids rate, gap 32 can have a moderate width. For a low solids rate, the gap needs to be smaller to provide the same resistance. For raw mixed sludge with primary sludge that has fiber and substrate materials, the width of gap 32 should be moderate, whereas for waste activated sludge or digested sludge without fibrous materials, the gap needs to be smaller. FIG. 10B shows a field example with very difficult-to-dewater, digested, waste activated sludge where the width of gap 32 should be ½ inch or smaller to achieve optimal dewatering.

Figure 12:
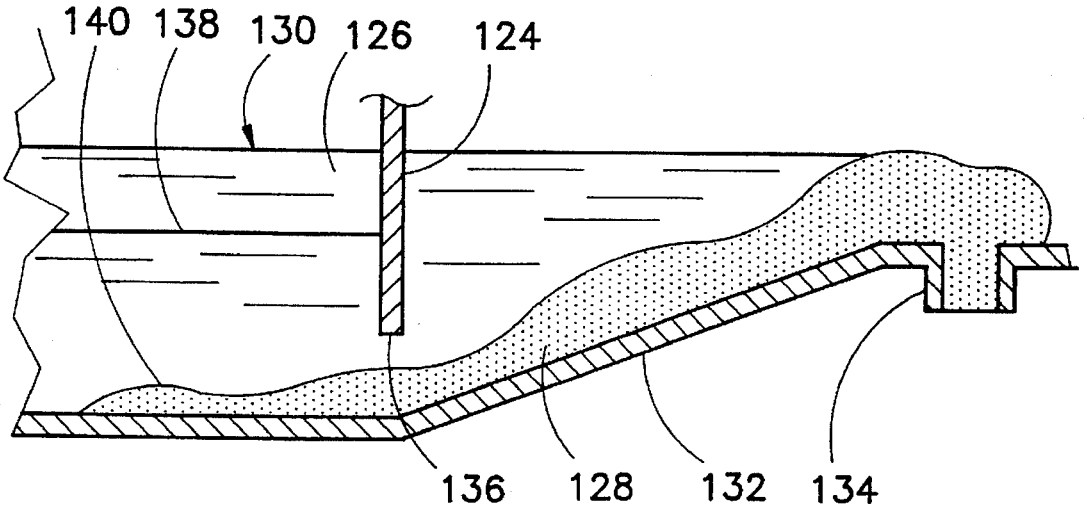
FIG. 12 is a schematic partial longitudinal cross-sectional view of a decanter centrifuge with a gating element in accordance with the present invention, depicting use of the gating element to facilitate a three-phase separation process.

FIG. 12 illustrates use of an adjustably positioned gating element 124 as described hereinabove to facilitate a three-phase separation process to prevent a lightest phase such as oil 126 from being entrained by a cake or solid phase 128 as the latter emerges from an oil-water pool 130 at a conical section 132 of a decanter centrifuge (not designated). Gating element 124 may take the form of a dip weir which is placed upstream of a solids emergence zone 134 so as to reduce entrainment of oil phase 126 by cake or solid phase 128. An outer edge 136 of dip weir 124 must penetrate beyond an oil-water interface 138 to be effective. A dip weir with a tight opening would be ideal if not for the fact that it might run into cake solids layer 128, which for granular solids can generate undesirable high torque. Given that the location of oil-water interface 138 and a water-solid interface 140 are not known, the centrifuge has to be operated with close monitoring of the oil discharged with the cake solids 128 and the torque level experienced by the machine. The adjustable gap enables optimization in response to the monitoring.

A decanter centrifuge with an adjustable gating element in accordance with the present invention is advantageous in the classification of fine solids wherein the "product" fine solids which stay near the pool surface due to lower settling velocity are allowed to pass with the liquid to the large end of the decanter centrifuge, while the "reject" coarser particles which settle quickly to the bowl wall are conveyed toward the conical discharge end. A dip weir in accordance with the invention blocks the fine solids from being entrained by the coarser cake solids as the solids emerge out of the separation pool and at the same time provides a requisite hydrostatic head to convey the coarse solids which might exhibit plastic fluid behavior, such as with kaolin cake. The positioning of the weir is critical in preventing loss of the fine solids and facilitating conveyance of the cake and may require adjustment for optimal machine performance. The flow control component enables such adjustment.

Although the invention has been described in terms of particular embodiments and applications, one of ordinary skill in the art, in light of this teaching, can generate additional embodiments and modifications without departing from the spirit of or exceeding the scope of the claimed invention. For example, where the conveyor has a plurality of screw flights, the gating element may be a plurality of baffle plates each disposed between adjacent wraps of the helical screws so that the cake distributed among the formed helical channels encounter similar restrictions in each channel. Where there are plural baffle plates, the baffle plates are disposed symmetrically about the rotation axis of the conveyor to facilitate or enhance balancing of the conveyor.

Accordingly, it is to be understood that the drawings and descriptions herein are offered by way of example to facilitate comprehension of the invention and should not be construed to limit the scope thereof.

What is claimed is:

1. A decanter centrifuge comprising:

a bowl rotatable about a longitudinal axis, said bowl having a cake discharge opening at one end and a liquid phase discharge opening;

a conveyor having at least a portion disposed inside said bowl for rotation about said longitudinal axis at an angular speed different from an angular rotational speed of said bowl, said conveyor including a helical screw disposed inside said bowl for scrolling a deposited solids cake layer along an inner surface of said bowl towards said cake discharge opening, said helical screw including a plurality of screw wraps, said screw wraps including a last screw wrap which is most proximate to said cake discharge opening, said screw wraps further including a penultimate screw wrap disposed next to said last screw wrap on a side thereof opposite said cake discharge opening;

a feed element extending into said bowl and said conveyor for delivering a feed slurry into a pool inside said bowl; and an adjustable gating element mounted to said conveyor between said penultimate screw wrap and said cake discharge opening, said gating element being spaced a variable and adjustable predeterminable distance from said inner surface of said bowl.

2. The centrifuge defined in claim 1 wherein said gating element includes a baffle plate disposed between said penultimate screw wrap and said last screw wrap.

3. The centrifuge defined in claim 2, further comprising a position adjustment mechanism mounted to said conveyor and operatively connected to said gating element for enabling a manual adjustment in the position of said gating element relative to said conveyor.

4. The centrifuge defined in claim 3 wherein said position adjustment mechanism includes a bolted-on baffle structure.

5. The centrifuge defined in claim 4 wherein said baffle structure is a balancing weight.

6. The centrifuge defined in claim 4 wherein said bowl is provided with at least one access opening for facilitating manual adjustment of said baffle structure.

7. The centrifuge defined in claim 3 wherein said position adjustment mechanism includes a hydraulic circuit.

8. The centrifuge defined in claim 3 wherein said position adjustment mechanism includes a camming mechanism.

9. The centrifuge defined in claim 3 wherein said position adjustment mechanism includes a lever mechanism.

10. The centrifuge defined in claim 2 wherein said penultimate screw wrap and said last screw wrap are provided with guides for guiding said baffle plate.

11. The centrifuge defined in claim 1 wherein said bowl has a cylindrical portion and a conical portion, said conical portion defining a beach area on said inner surface, said gating element including an annular dip weir disposable at different longitudinal positions along said conveyor, said dip weir being disposed at all times between said last screw wrap and said cake discharge opening.

12. The centrifuge defined in claim 11 wherein said bowl is provided with at least one access opening for facilitating manual adjustment in the position of said dip weir.

13. The centrifuge defined in claim 11 wherein said beach area includes a first section of a steep slope and a second section of a less steep slope, said second section being located between said first section and said cake discharge opening, said dip weir being positionable along said second section, said first section and said second section each having a diameter which decreases with axial displacement towards said cake discharge opening, said first section having a diameter which decreases at a relatively large rate with axial displacement towards said cake discharge opening, said second section having a diameter which decreases at a smaller rate with axial displacement towards said cake discharge opening.

14. The centrifuge defined in claim 1 wherein said bowl is provided with at least one access opening for facilitating manual adjustment in the position of said gating element.

15. The centrifuge defined in claim 1, further comprising locking hardware mounted to said conveyor and operatively connected to said gating element for enabling a locking of said gating element to said conveyor at different positions so as to vary said predeterminable distance.

16. A decanter centrifuge comprising:

a bowl rotatable about a longitudinal axis, said bowl having a cake discharge opening at one end and a liquid phase discharge opening; and a conveyor having at least a portion disposed inside said bowl for rotation about said longitudinal axis at an angular speed different from an angular rotational speed of said bowl, said conveyor including a helical screw disposed inside said bowl for scrolling a cake layer along an inner surface of said bowl towards said cake discharge opening, said conveyor having an adjustable gating element defining an adjustable gap with respect to said inner surface of said bowl, said gap having a size adjustable independently of conveyor rotation speed, said helical screw including a plurality of screw wraps, said screw wraps including a last screw wrap which is most proximate to said cake discharge opening, said screw wraps further including a penultimate screw wrap disposed next to said last screw wrap on a side thereof opposite said cake discharge opening, said gating element being axially located between said penultimate screw wrap and said cake discharge opening; and a feed element extending into said bowl and said conveyor for delivering a feed slurry into a pool inside said bowl.

17. The centrifuge defined in claim 16 wherein said conveyor is provided with locking hardware for maintaining said gating element at a predeterminable location relative to said conveyor, said gating element including an edge defining said gap with said inner surface, said edge being spaced from said inner surface by an adjustable distance.

18. The centrifuge defined in claim 17 wherein said gating element includes a baffle plate disposed between said penultimate screw wrap and said last screw wrap.

19. The centrifuge defined in claim 18 wherein said locking hardware includes a hydraulic circuit.

20. The centrifuge defined in claim 18 wherein said locking hardware includes a camming mechanism.

21. The centrifuge defined in claim 18 wherein said locking hardware includes a rocker-arm lever mechanism.

22. The centrifuge defined in claim 17 wherein said conveyor is provided with a position adjustment mechanism connected to said gating element for enabling an adjustment in the position of said gating element relative to said conveyor.

23. The centrifuge defined in claim 17 wherein said bowl has a cylindrical portion and a conical portion, said conical portion defining a beach area on said inner surface, said gating element including an annular dip weir disposable at different longitudinal positions along said conveyor, said dip weir being disposed at all times between said last screw wrap and said cake discharge opening.

24. The centrifuge defined in claim 23 wherein said bowl is provided with at least one access opening for facilitating manual adjustment in the longitudinal position of said dip weir along said conveyor.

25. The centrifuge defined in claim 23 wherein said beach area includes a first section of a steep slope and a second section of a less steep slope, said second section being located between said first section and said cake discharge opening, said dip weir being positionable along said second section, said first section and said second section each having a diameter which decreases with axial displacement towards said cake discharge opening, said first section having a diameter which decreases at a relatively large rate with axial displacement towards said cake discharge opening, said second section having a diameter which decreases at a smaller rate with axial displacement towards said cake discharge opening.

26. The centrifuge defined in claim 23 wherein said bowl is provided with at least one access opening for facilitating manual adjustment of said gating element to vary said adjustable distance.

* * * * *